US007204790B2

(12) United States Patent
Sleamaker

(10) Patent No.: US 7,204,790 B2
(45) Date of Patent: Apr. 17, 2007

(54) MULTI-SPORT TRAINING MACHINE WITH INCLINED MONORAIL AND ROLLER CARRIAGE

(75) Inventor: Robert H. Sleamaker, c.o VASA, Inc., 1 Allen Martin Dr., #5, Essex Junction, VT (US) 05452

(73) Assignee: Robert H. Sleamaker, Underhill, VT (US)

( * ) Notice: Subject to any disclaimer, the term of this patent is extended or adjusted under 35 U.S.C. 154(b) by 794 days.

(21) Appl. No.: 09/805,711

(22) Filed: Mar. 13, 2001

(65) Prior Publication Data

US 2002/0132706 A1 Sep. 19, 2002

(51) Int. Cl.
*A63B 21/00* (2006.01)

(52) U.S. Cl. ..... 482/96; 482/142; 482/51

(58) Field of Classification Search ..... 482/51, 482/57, 95–96, 142, 56, 71–73, 148, 121, 482/126

See application file for complete search history.

(56) References Cited

U.S. PATENT DOCUMENTS 4,911,438 A * 3/1990 Van Straaten ..... 482/96
4,913,424 A * 4/1990 Pepin ..... 482/144
5,013,033 A * 5/1991 Watterson et al. ..... 482/72
5,125,649 A * 6/1992 Fuller ..... 482/123
5,354,251 A * 10/1994 Sleamaker ..... 482/96
5,620,403 A * 4/1997 Lundin ..... 482/96
5,669,864 A * 9/1997 Brister ..... 482/132
5,938,571 A * 8/1999 Stevens ..... 482/96
5,967,955 A * 10/1999 Westfall et al. ..... 482/142
6,238,322 B1 * 5/2001 Hsu ..... 482/96

* cited by examiner

*Primary Examiner*—Stephen R. Crow
(74) *Attorney, Agent, or Firm*—Donald W. Meeker

(57) ABSTRACT

An inclined monorail mounts between an adjustable front stanchion and lower rear stanchion. A roller carriage, having a padded bench or seat and spool-shaped rollers, rolls on the monorail. Elasticized tension straps attach between the roller carriage and the front or the rear stanchion to assist or resist the movement of the roller carriage. The user pulls on interchangeable handles either on pull straps on a front bar or a cable pulley system attached to the front stanchion and to the roller carriage to exercise and simulate various sports movements while moving the roller carriage. The stanchions pivot flat onto the monorail to transport the apparatus on a stanchion wheel or mount it vertically on a wall bracket and the cable pulley system lifts the roller carriage vertically with weights on the roller carriage. A detachable foot platform attaches to the rear stanchion for performing leg exercises.

28 Claims, 5 Drawing Sheets

FIG. 9
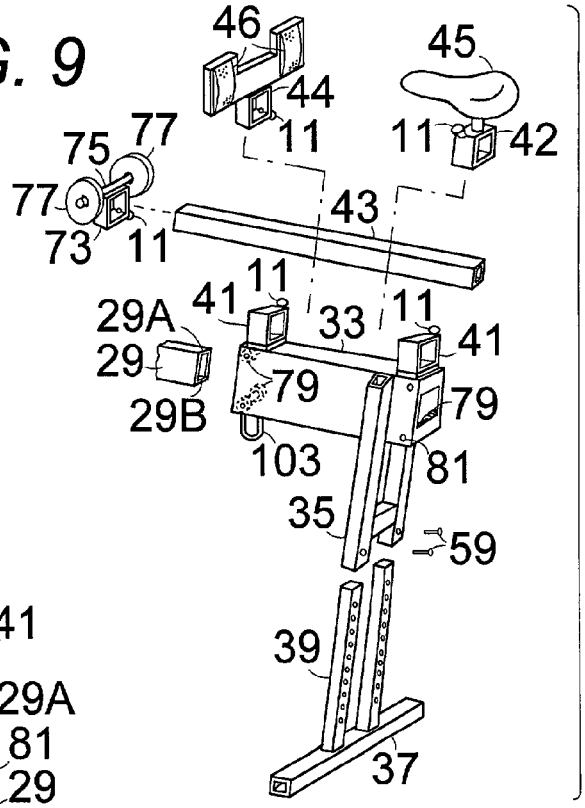
FIG. 10
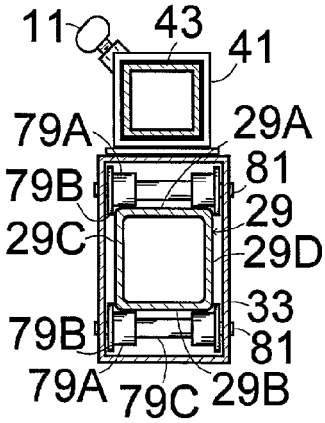
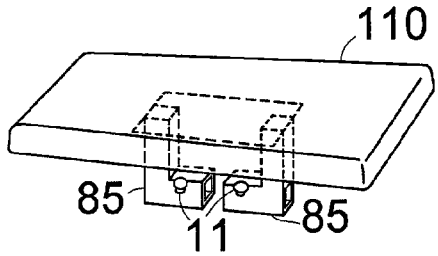
FIG. 11
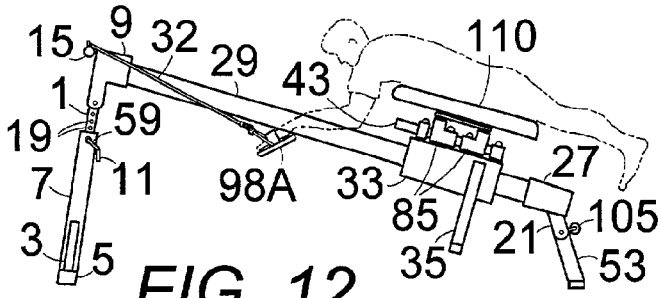
FIG. 12

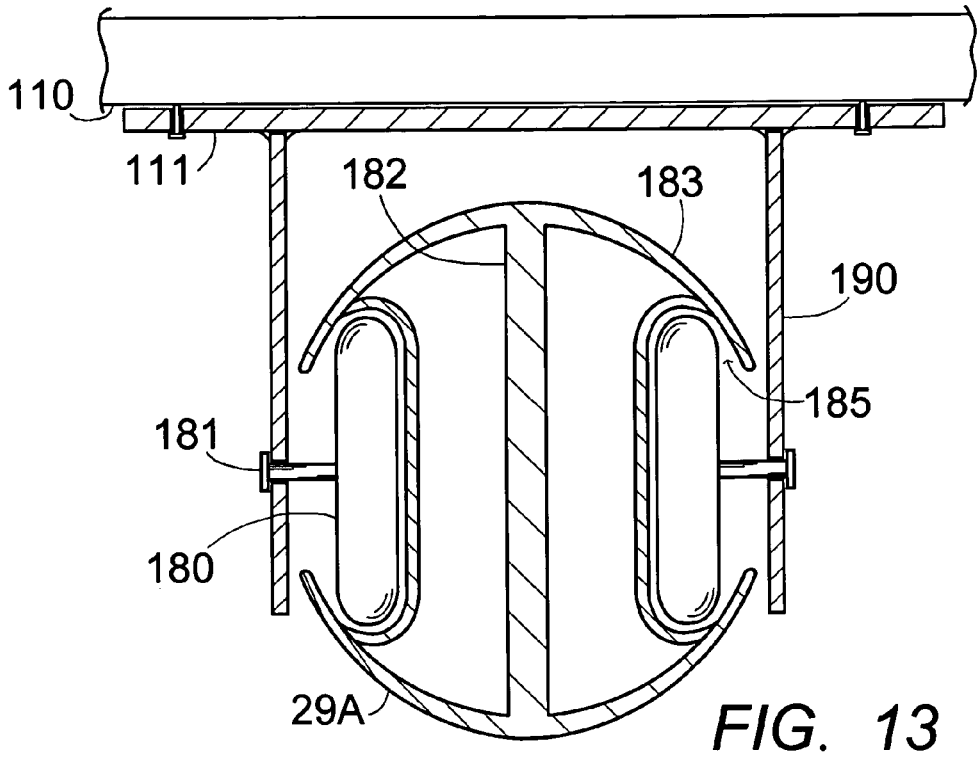
FIG. 13
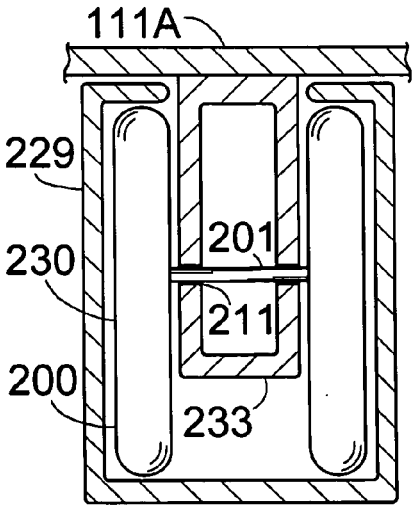
FIG. 14
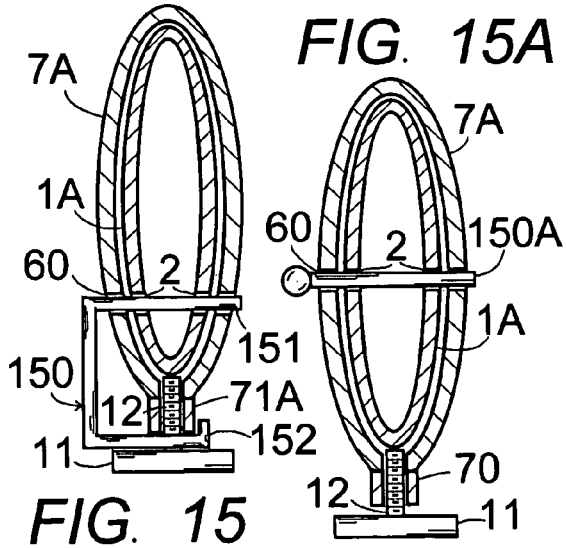
FIG. 15
FIG. 15A

MULTI-SPORT TRAINING MACHINE WITH INCLINED MONORAIL AND ROLLER CARRIAGE

DESCRIPTION

1. Technical Field

The present invention relates generally to exercise machines. More specifically, the invention is an exercise and therapy machine used in multi-sports training and cross training and employing a roller carriage mounted on an inclined monorail with resistive and assistive stretch cords between the carriage and the structure, pull cords and an alternate pulley cable system, and a number of attachments for simulating the movements involved in a variety of sports activities, facilitating strength, endurance, power and speed as well as serving for use in functional training, physical therapy and rehabilitation.

2. Background of the Invention

There is a recognized need for sports specific training devices to help athletes develop strength, endurance, power and speed related to their sports activity. Additionally recognized is the need for cross training to balance the muscles of the athlete and provide greater flexibility in performance.

Because there is a limit to the strength that can be developed in the actual performance of the sport, having machines simulating the actual sports activity, but pushing the strength requirement to a higher level will increase the performance of the athlete beyond what would be possible by practicing the sports activity alone.

Furthermore, with seasonal sports, such as swimming and skiing, and limited access to facilities, such as swimming pools and snow-covered ski slopes and trails, it is important to provide sports specific training devices to keep the athlete in shape for their sport year-round regardless of weather conditions or access to facilities.

While there are many exercise machines now available for providing sports specific cardiovascular and muscular development to athletes and other persons, most only apply to one sport and do not provide an extensive range of movement training both within the specific sport activity and for cross training.

These prior art machines are particularly useful for skiers and other athletes preparing to participate in seasonal sports. Conventional exercise machines include weight lifting exercise units as described in S. Pat. No. 3,614,097, rowing machines as described in U.S. Pat. Nos. 3,586,322 and 4,004,801, and cross country ski exercisers such as those described in U.S. Pat. Nos. 4,023,795, 4,434,981, and 4,659,077.

None of the prior art devices, except for the applicant's U.S. Pat. No. 5,029,848, provide a training machine designed for a variety of motions simulating various swimming strokes as well as a number of other specific sports training movements.

Furthermore, the prior art exercise machines for skiing, except for the applicant's U.S. Pat. No. 5,029,848, do not specifically simulate the current poling techniques used in cross country skiing. For example, conventional ski exercisers are not designed to simulate a cross country skiing technique in which skiers move both their arms in unison to propel themselves forward with both poles simultaneously. On the other hand, conventional exercise machines that do allow a user, in a seated or prone position, to pull with both arms simultaneously have not been designed for use by standing users, and hence do not simulate skiing activity.

Further, other than the applicant's U.S. Pat. No. 5,029,848, prior art ski exercisers such as those described above simulate only a particular type of exercise activity (i.e., a skiing motion) and are not designed to accept interchangeable components that may be used to simulate other forms of athletic activity, such as swimming, surfing, rock climbing, or any of a variety of other sports activities or cross training activities.

None of the prior art devices provide an athletic training device which is also designed for use in general strength and conditioning, physical therapy and rehabilitation.

SUMMARY OF THE INVENTION

One object of the present invention is to provide a multiple sports simulation training and exercise machine using an inclined monorail and mounted roller carriage, the machine having an overall profile which is low to the ground so that the rear support stanchion of the machine is just high enough (approximately 14") to permit the legs of the user to extend off the back end of the machine without touching the ground when the user is reclined on the carriage. This low profile provides ease of mounting and a steep angle of incline between the low rear stanchion and the adjustable front stanchion for greater gravitational resistance. It is a lighter and smaller device for ease of handling and storage and there is less chance of injury should the user fall from the machine.

Another object of the present invention is to provide a round tubular strap bar that bolts to the front stanchion head and has strap guides to accept webbing pull straps, holes to accept eye bolts for attaching a pulley cable system, and rubber handle grips on the ends for doing pull-ups and other exercises, thereby creating a versatile means for attaching the necessary straps and adding more exercise value to the machine.

An alternate object of the present invention is to provide a radial strap bar attachable to the front stanchion for allowing the user to adjust the right and left strap bar segments to different settings or angles relative to the monorail to vary exercise patterns, simulating different strokes and exercising different muscle groups.

A further object of the present invention is to provide a snap hook on the end of each webbing pull strap and pulley system cable that allows changing between round handles, hand paddles, ankles straps, webbing loops, canoe paddle shaft, kayak paddle shaft, barbell accessory, or other desired gripping means.

An ancillary object of the present invention is to provide a pulley cable system with two pulleys attached to the strap bar and the cable and third pulley attached to the roller carriage, which system can be used while the user is mounted on the roller carriage or with the user standing off the machine for various types of exercises. The pulley cable system allows the user to do continuous alternating arm exercises simulating freestyle swimming or single poling exercises for nordic skiing, to reduce the load by providing a mechanical advantage, and to provide multi-plane functional exercises.

An additional object of the present invention is to provide an optional dynamic dampening loop attached between the middle pulley and the roller carriage for smoothing out the motion.

Still another object of the present invention is to provide on a front base bar supporting the front stanchion an attached eyebolt on either side of the front stanchion to accept the two outermost pulleys of the pulley cable system so that exercises can be done pulling at a different angle allowing various other kinds of exercises using different muscle groups.

A still further object of the present invention is to provide pivotable means in the front and rear stanchions to enable the stanchions to fold up so that the machine is in a flat configuration for ease of transporting and storing.

A related object of the present invention is to provide a wheel on one of the stanchions which contacts the ground with the machine in the folded configuration to allow rolling the machine for ease of movement.

One more object of the present invention is to provide rounded oval shaped stanchions and monorail for greater ease of handling in grasping a narrower rounded edge rather than wide sides with relatively sharp corners. The user will be less likely to bump the stanchion and monorail accidentally with no squared edges protruding. Rounded oval elements have greater structural strength.

A related object of the present invention is to provide larger roller wheels on the roller carriage for a smoother rolling motion with less friction.

Another related object of the present invention is to provide channels inside the monorail within which channels the wheels of the roller carriage roll to prevent the wheels from slipping off and dumping the roller carriage.

Still one more object of the present invention is to provide a weight bracket and bar attach to the underside of the seat carriage for adding free weight plates to the bracket bar to increase resistance.

Yet another object of the present invention is to provide a rubber stretch cord attachable between the rear stanchion and the roller carriage to provide more resistance.

A related object of the present invention is to provide a number of interchangeable rubber stretch cords of different tension strengths to vary the degree of resistance.

Another related object of the present invention is to provide interchangeable rubber stretch cords attachable between the front stanchion head and the roller carriage, thereby giving a variable dynamic assistance for forward motion, much like reducing the user's weight.

Still another object of the present invention is to provide a long (36" or 40") padded bench contoured to cradle the body of the user lying on the bench and wide to accommodate a wide range of body sizes while tapering in the front to provide greater freedom of movement of the arms and maximum stability for use in simulated swimming movements.

An alternate object of the present invention is to provide a seat carriage, such as a bike seat, having a thigh pad and foot pegs, which may be substituted for the bench for simulated skiing movements in a standing position.

Another alternate objective of the present invention is to provide the seat carriage with an attachable rear foot support that extends toward the rear of the machine and mounts underneath the padded bench and an attachable head rest extending toward the front of the unit for performing other types of exercises.

A supplementary object of the present invention is to provide a foot platform attachable to the rear stanchion so that users may push off the platform with the feet.

One more object of the present invention is to provide a telescoping tube on the front stanchion to allow adjustability of the height of the front stanchion and therefore adjustability of the angle of the inclined monorail attached between the stanchions and having a series of numbers on the telescoping tube to indicate each height setting for accurate adjustment of the incline.

A structural object of the present invention is to provide all frame parts fabricated of stainless steel or regular steel that is coated in powder coat epoxy or aluminum or plastic and a monorail that is made from stainless steel, aluminum or chrome plated steel, depending on the model, for durability and resistance to corrosion, especially important if the machine is used in a damp environment, such as adjacent to a pool or the ocean.

An additional functional object of the present invention is to provide a rock climber attachment mounted to the front stanchion and serving as a platform that accepts a variety of standard rock climbing wall grips, hand holds, etc. to use the machine to simulate rock climbing movements.

One further object of the present invention is to provide wall-mountable brackets to enable the machine to be mounted vertically on a wall so that the pulley cable system may be used to raise the seat carriage with weight bracket attached or rubber tubing attached, thereby creating a vertical pulley exercise device.

In brief, the present invention is an exercise machine, including a front stanchion assembly, which is preferably inclined inwardly at an angle substantially equal to 70 degrees from horizontal for enhanced stability, and a rear stanchion assembly, which substantially shorter than the front stanchion and is also preferably inclined inwardly for enhanced stability. A monorail is mounted between the stanchion assemblies at an incline, and a roller carriage is mounted so as to be capable of rolling along the monorail.

A user supported by the roller carriage lying on a padded bench for swimming simulation training or in a standing position on a seat carriage having foot pegs and a thigh pad for ski simulation training, pulls on straps attached at one end to the front stanchion to roll the carriage up the inclined monorail. The roller carriage is preferably designed so that the padded bench and the seat carriage may be interchangeably mounted thereon. The padded bench also allows users to sit, kneel, lay supine, face forward and backward to do a range of over 150 exercises.

A telescoping tube in the front stanchion may be extended, lengthening the front stanchion, to increase the incline requiring more strength for the user to pull his or her body up the incline and providing strengthening the users muscles. Also, any of a series of variously tensioned rubber cords or tubing may be attached between the roller carriage and the rear stanchion for adjustably increased resistance.

Alternately lowering the front stanchion will decrease the incline and attaching any of a series of variously tensioned rubber cords between the front stanchion and the roller carriage will assist the user for a lighter workout, especially important for endurance and long distance training with many repetitions of the exercise required.

A snap hook on the end of each webbing pull strap and pulley system cable allows changing between round handles, hand paddles, ankles straps, webbing loops, canoe paddle shaft, kayak paddle shaft, barbell accessory, or other desired gripping means.

Also in a preferred embodiment, a telescoping sleeve releasably connects the monorail to the front stanchion assembly, so that the point of attachment of the monorail relative to the front stanchion assembly may be readily adjusted.

Preferably, the inventive apparatus also includes a pulley-cable system which allows the user to perform a wide variety of exercises. In the pulley-cable system, one pulley is attached to the roller carriage, and the cable is then looped through pulleys at the front (and possibly rear) stanchion. The ends of the cable have snap hooks for attaching any of a variety of gripping devices including an ankle strap (to allow the user to perform leg exercises), and a handle bar (to allow the to perform arm exercises).

The roller carriage is preferably designed with a weight bracket and weight bar attached so that weights may be readily attached to it so that the user may readily adjust the force that must be applied to the cable (i.e., the force applied to the ankle strap or handle bar) to translate the carriage. A dynamic dampening loop may be attached between the cable and the roller carriage.

A primary advantage of the present invention is that it can be used for sports-specific training by swimmers, surfers, triathletes, rowers, cross country skiers, gymnasts and other athletes to condition the exact muscle movements experienced in their sport, simulating the sport movement and training the "muscle memory" or neuromuscular function, allowing the athlete to improve technique and efficiency while gaining strength and endurance.

Another primary advantage of the present invention is that it permits the simulation of the actual movements involved in the various sporting events at both greater and lesser resistances to allow for increased strength training and repetitive endurance training and on a year-round basis when the actual sporting event activities are not possible.

Another advantage of the present invention is that, in addition to providing a range of sporting event simulation training activities, it is adaptable also for cross training enabling athletes to perform better by building all around strength and conditioning due to its versatility and wide range of resistance options for complete strength programs and exercising critical muscle groups that are antagonistic to the primary mover muscles used in their sport.

A further advantage of the present invention is that it provides users with functional strength training on a regular basis, enabling performance improvement and injury prevention with over 150 strength exercises possible including strength routines for every part of the body, including abdominal, arms, back, chest, legs and shoulders.

An additional advantage of the present invention is the variety of exercises possible with the invention for increased endurance with simultaneous aerobic exercising of the arm, abdominal and leg muscles, including the exercises simulating freestyle swimming, surf paddling or single-poling for cross-country skiing.

Another advantage of the present invention for swimmers is that it provides a way to stay in shape while recovering from an ear infection or other ailment that prevents the swimmers from conditioning in the water.

Still another advantage of the present invention is that it enables the user to do plyometrics to build power and speed for the legs and the upper body to achieve great vertical leap and explosive jumping power benefits.

One more advantage of the present invention is that it provides non-weight bearing and multi-plane exercises, for use by physical therapists, doctors, athletic trainers, personal trainers, and coaches using the wide range of resistance options and accessories to provide unlimited exercises for injured athletes and patients, from post-operative patients to "back in action" athletes to stay in shape.

Yet another advantage of the present invention is that it provides larger wheels on the roller carriage rolling inside channels in the monorail for a smoother safer ride along the monorail.

BRIEF DESCRIPTION OF THE DRAWINGS

Additional objects and advantages of the present invention will be shown in conjunction with the drawings, which are furnished merely in illustration, but not in limitation of the invention, in which drawings:

FIG. 9 is an exploded perspective view of a portion of the alternate embodiment of the invention of FIG. 4, showing the seat components aligned for assembly;

FIG. 10 is a cross-sectional view taken transversely through the roller carriage 33 and monorail of FIG. 4;

FIG. 11 is a perspective view of a padded bench which may be substituted for the bicycle seat of the FIG. 4 embodiment of the invention;

FIG. 12 is a side elevational view of a portion the FIG. 4 embodiment of the invention in which the padded swim bench of FIG. 11 is substituted for the bicycle seat shown in FIG. 4;

FIG. 13 is a cross-sectional view taken through another alternative roller carriage padded bench having plate 111A and monorail 229 of an alternate embodiment of the invention of FIG. 1;

FIG. 14 is a cross-sectional view taken through an alternate embodiment the front stanchion at the locking mechanism 150;

FIG. 15 is a cross-sectional view taken through an alternate embodiment the front stanchion at the locking mechanism 150;

FIG. 15A is a cross-sectional view taken through the alternate embodiment of the front stanchion of FIG. at an alternate embodiment of the locking mechanism 150A.

DETAILED DESCRIPTION OF THE PREFERRED EMBODIMENTS

Figure 1B:
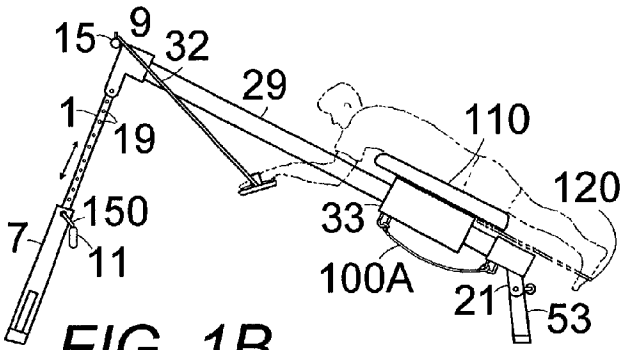
FIG. 1B is a side elevational view of the preferred embodiment of the invention of FIG. 1 reduced in size and complexity and show the front stanchion elevated to increase the incline to a greater angle than that shown in FIG. 1A.

In FIGS. 1–12, an exercise apparatus enables simulating a variety of sports activities for the purpose of training. The apparatus has an inclined monorail 29 attached at a front end to a front support bracket 9 on a front rigid support structure comprising a hollow front stanchion support 7 having a laterally extending base 5 secured by triangulation supports 3 and a telescoping tube 1 inserted adjustably into the front stanchion support 7 and into the front support bracket 9 to allow adjustability of the height of the front support structure and therefore adjustability of the angle of the inclined monorail 29.

Figure 1A:
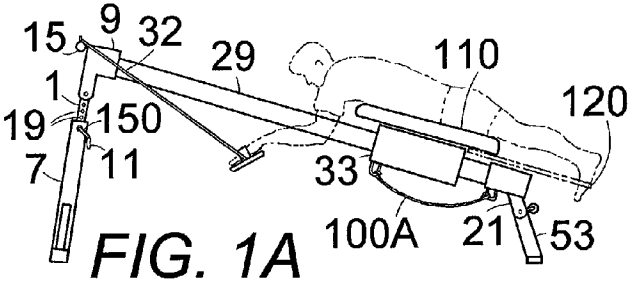
FIG. 1A is a side elevational view of the preferred embodiment of the invention of FIG. 1 reduced in size and complexity.

The telescoping tube 1 bears a series of numbers 19 to indicate each height setting for accurate adjustment of the inclined monorail 29. In FIG. 1A the monorail 29 is shown at a relatively low angle. In FIG. 1B the telescoping tube 1 of the front support has been raised upward to put the monorail 29 at a much steeper inclined angle to increase the effort required to move the roller carriage 33 up the inclined monorail 29.

Figure 1:
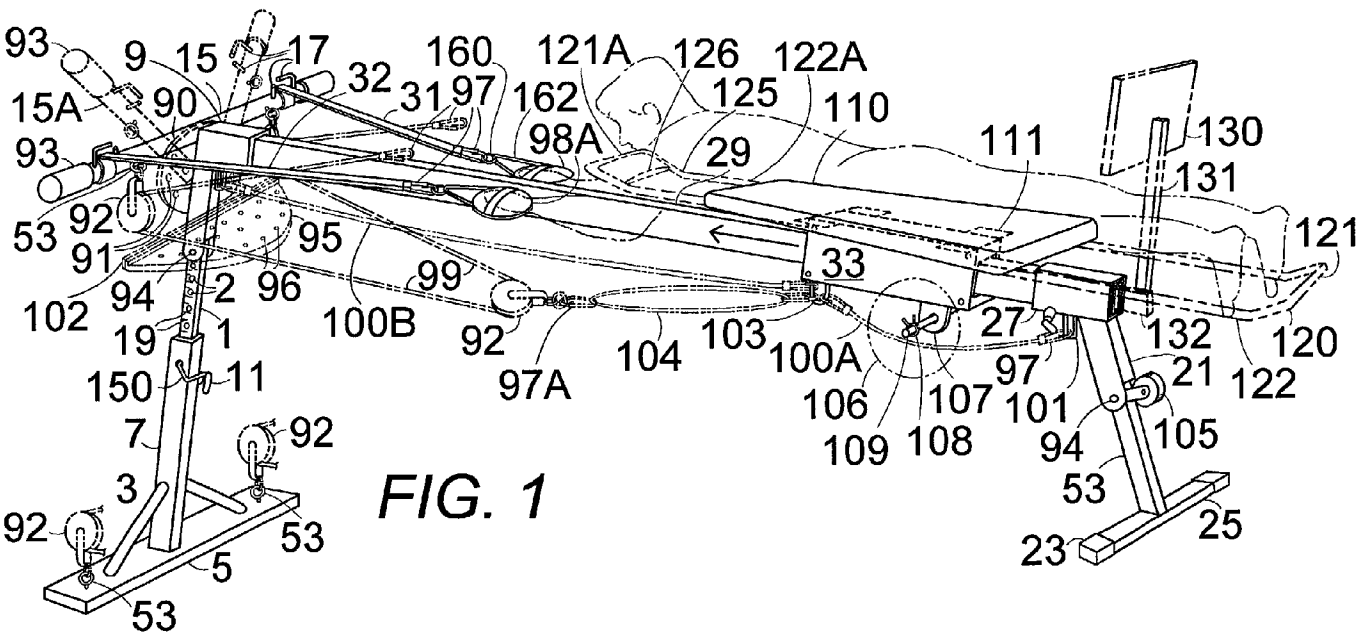
FIG. 1 is a perspective view of the preferred embodiment of the invention having a padded bench mounted to a roller carriage riding along an inclined monorail.
Figure 6:
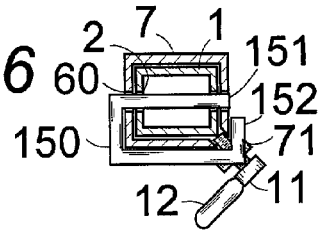
FIG. 6 is a cross-sectional view taken through the front stanchion at the preferred embodiment of the locking mechanism 150.

In FIGS. 1 and 6, a safety locking pin 150 formed of rigid metal has a straight insertion portion 151 insertable through opening 60 in the front stanchion support 7 and through openings 2 in the telescoping tube 1, and an L-shaped arm 152 which drops down onto the quick release screw mechanism 11 and is secured by the tightening of the quick release mechanism 11. The quick release assembly 11 includes a threaded housing 71 and screw portion 12. The housing 71 is fixedly attached to the sleeve of the stanchion 7 around an orifice through sleeve. To lock members 1 and 7 together, the threads of screw 12 engage with the threads of housing 71 so as to advance the screw 12 inward through the orifice into direct contact with the telescoping tube 1. Screw 72 may be unscrewed (away from the telescoping tube 1) to release the telescoping tube 1 from the sleeve of the stanchion 7.

Figure 6A:
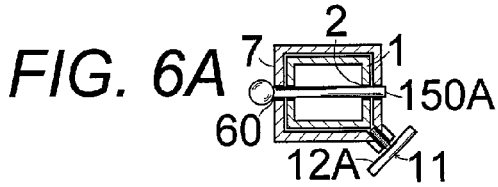
FIG. 6A is a cross-sectional view taken through the front stanchion at an alternate embodiment of the locking mechanism 150A.

In FIGS. 1 and 6A, a straight pin 150A is inserted through the openings 60 in the stanchion 7 and the openings 2 in the tube 1 and the quick release screw mechanism 11 works the same way as in FIG. 6 except that it does not engage the pin. The combination of a safety pin and quick release assembly shown in FIGS. 6 and 6A may be employed at any of the adjustment points of the inventive system.

At a rearward end the inclined monorail 29 is attached to a rear support bracket 27 of a rear rigid support structure pivotally connected to a rear stanchion support 53 with a cross base portion 25 having rubber-like high-friction sleeves 23 on each end. The rear support structure is lower than the front support structure thereby creating the adjustable incline. The support structures are angled inwardly, preferably at approximately 70 degrees from the horizontal, for stability of the apparatus.

A roller carriage 33 is mounted on the incline monorail 29 so that the roller carriage 33 is capable of rolling along the inclined monorail 29 between the rigid support structures. A body support means, such as the padded bench 110 of FIG. 1 or the seat 45 of FIG. 4, removably attached to the roller carriage and capable of receiving a body of a user (shown dashed) mounted thereon. The rear support structure is of a minimum height required to maintain a user mounted on the body support means in a reclined position, inclined at an angle to the horizontal, so that the user's feet do not touch a horizontal surface supporting the apparatus. Preferably, the rear support structure is 14" high.

In FIGS. 1, 3, 5, 8, 11, 12, and 13 the body support means comprises an elongated padded bench 110 contoured to cradle the body of the user lying on the bench and sufficiently wide to accommodate a wide range of body sizes while tapering in the front to provide greater freedom of movement of the arms and maximum stability for use in simulated swimming movements.

In FIG. 1, a U-shaped rear foot support 120, having a rigid transverse foot bar 121 and two rigid longitudinal supports 122 bolted to the underside of the rear of the roller carriage 33, is capable of being removably attached to the padded bench and extending toward the rear of the apparatus in the plane of the padded bench to support the feet of the user for performing various types of exercises. A U-shaped front head support 125 with a rigid transverse head bar 121A, a head pad 126, and two rigid longitudinal supports 122A may be bolted to the underside of the front of the roller carriage 33. The head support 125 is capable of being removably attached to the padded bench and extending toward the front of the apparatus in the plane of the padded bench to support the head of the user for performing various types of exercises.

A foot platform 130 comprising a rigid upright planar surface is attachable to the rear support structure by a foot platform bracket 132 secured within the rear monorail bracket 27 inside end of the monorail and the foot platform 130 is held securely in an upright position by a rigid upright support 131 extending upwardly from the bracket 132 and extends upwardly perpendicularly to the monorail, so the user may push off the foot platform 130 with the feet while the user is mounted on the body support means.

A weight bracket 107 and weight bar 109 are attached to an underside of the roller carriage 33, the weight bar capable of removably receiving a weight means 106 held in place by a spring clip 108 to increase the weight of the roller carriage and therefore the resistance to pulling the roller carriage up the inclined monorail 29 to increase the strength of the exerciser.

A tension means, such as an elasticized cord 100A and 100B with end hooks 97, is removably attachable between the roller carriage 33 and one of the support structures for altering the ability to move the roller carriage along the inclined monorail. The tension means, the elasticized cord 100A and 100B, comprises one of a number of interchangeable rubber stretch cords of different tension strengths to vary the degree of tension by interchanging the cords. With the tension means, the elasticized cord 100A, attached between the roller carriage 33, from loop 103, and the rear support structure, from D-loop 101, the tension means is capable of resisting the movement of the roller carriage up the inclined monorail to increase the effort required to move the roller carriage 33 and consequently the exercise value for increasing strength. With the tension means, the elasticized cord 100B, attached between the roller carriage 33, from loop 103, and the front support structure, from D-loop 101, the tension means is capable of assisting the movement of the roller carriage appropriate to certain exercises.

An elongated rigid bar 15 is mounted on the front support structure by bolts or other securing means. A flexible pull means, such as webbing straps 31 and 32, preferably wrapped around the rigid bar 15, and pulley cable system 99, is attached to the front support structure so that a user mounted on the body support means is capable of using the pull means to simulate sports movements and move the roller carriage 33 from the rear support structure up the inclined monorail toward the front support structure in the direction of the arrows of FIGS. 1 and 4. The rigid bar 15 has a guide means 17, such as an inverted L-shaped bracket and spaced apart upright post, on each side of the front support structure for maintaining the pull means, such as the webbed straps 31 and 32, in a fixed position wrapped around the bar 15.

An adjustable bar support 90 in the form of a circular rigid plate is attachable to the front support structure by bolts or other means in addition to or in place of the rigid bar 15. A pair of adjustable bars 15A form a right bar and a left bar adjustably attachable to the adjustable bar support 90 in any of a variety of different settings or angles relative to the monorail, the adjustable bars removably bolted into selected holes 91 formed in an array of radially paired holes in the adjustable bar support 90. The right and left bars 15A each having one of the flexible pull means, such as webbing straps 31 and 32 attached thereto in guide means 17, to allow the user to vary exercise patterns with the adjustable bars 15A set at various angles, simulating different strokes and exercising different muscle groups.

The bar 15 and the pair of adjustable bars 15A further comprise a gripping means, such as rubber hand grips 93 at each end, each of the gripping means round in cross section for facilitating gripping by a hand of a user to allow the user to perform exercises while grasping the gripping means.

Additionally, a pulley 92 is attachable to the bar 15 to a pulley attaching means, such as an eye bolt 6, on each side of the front support structure and a cable 99 inserted through each of the pulleys 92, the middle pulley of the pulley cable system having a looped portion attached to the roller carriage to loop 103 and two ends free to grasp by a user with snap hooks 97 to receive any of a variety of gripping means attached thereto, the cable 99 capable of being used while the user is mounted on the roller carriage 33 or with the user seated or standing adjacent to the apparatus for various types of exercises. A middle pulley 92 receives the looped portion of the cable 99 from the pulleys on the bar and a tension loop 104 is attachable between the middle pulley 92 by hook 97A and the roller carriage 33 to loop 103, the tension loop 104 forming a dynamic dampening loop.

The front support structure further comprises a base bar 5 extending laterally to each side of the front support structure, each of the base bars having a pulley attaching means, such as an eye bolt 6 attachable thereto for receiving each of the pulley means 92 attachable thereto so that exercises can be done pulling at a different angle allowing various other kinds of exercises using different muscle groups.

Figure 4:
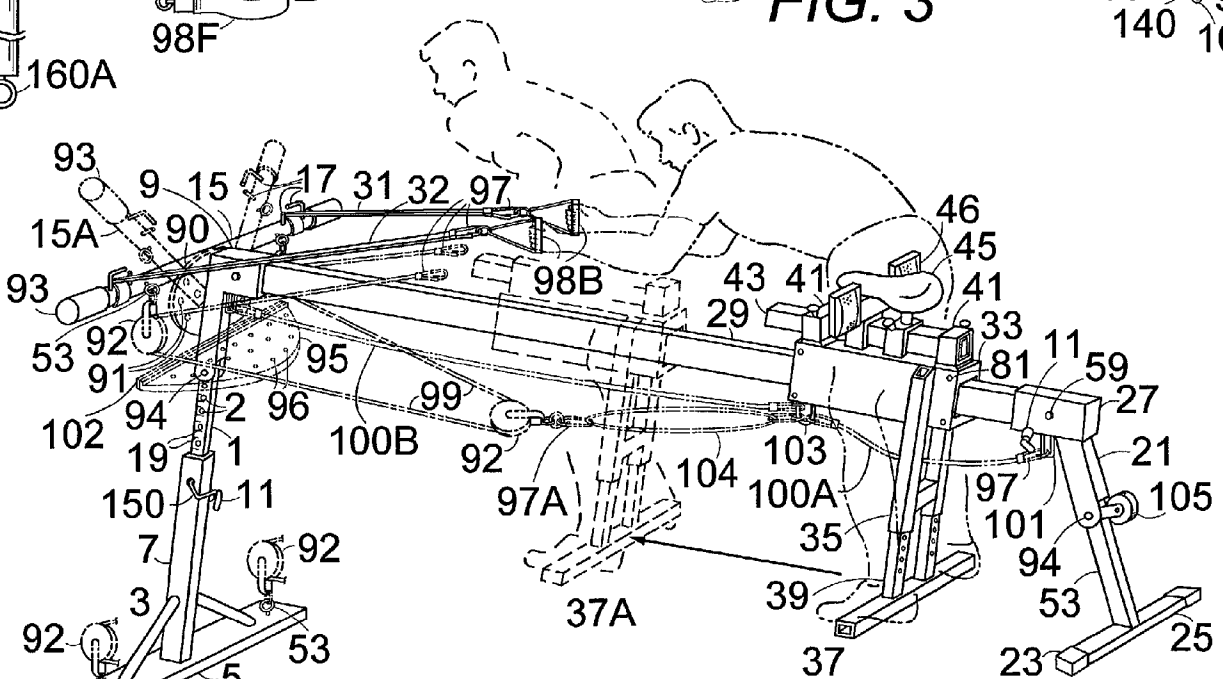
FIG. 4 is a perspective view of an alternate embodiment of the invention having a seat mounted on the roller carriage on the inclined monorail.

The ends of the cable 99 and the ends of the webbing straps 31 and 32 have hooks 97 capable of receiving interchangeably a gripping means selected from the group of gripping means consisting of: a hand paddle 98A, as in FIG. 1, with a loop of webbing 162 through a metal ring 160 for receiving one of the hooks 97 for receiving a hand of the user flat against the hand paddle; an elongated handle 98B, as in FIG. 4, round in cross section with a loop of webbing 162 through a metal ring 160 for receiving one of the hooks 97 with the handle attached perpendicularly to the cable means; a canoe paddle shaft 98C, as seen in FIG. 2A, with an eye bolt 160A on the end of the shaft for receiving one of the hooks 97; a kayak paddle shaft 98D, or a barbell accessory, with an eye bolt 160A on each end of the shaft for receiving the hooks 97, as seen in FIG. 2B; an ankle strap 98E securable around an ankle of a user with Velcro or other adjustable securing means 163, as seen in FIG. 2C, with an attached metal ring 160 for receiving one of the hooks 97; and a webbing loop 98F, as seen in FIG. 2D, with an attached metal ring 160 for receiving one of the hooks 97.

A rock climber attachment 95 mountable on the front support structure attached by a rigid elongated bracket 102 by bolts or other means, the rock climber attachment 95 formed of a rigid half round plate mounted horizontally with an array of openings 96 therein to serve as a platform that accepts a variety of standard rock climbing wall grips and hand holds to use the apparatus to simulate rock climbing movements.

Figure 3:
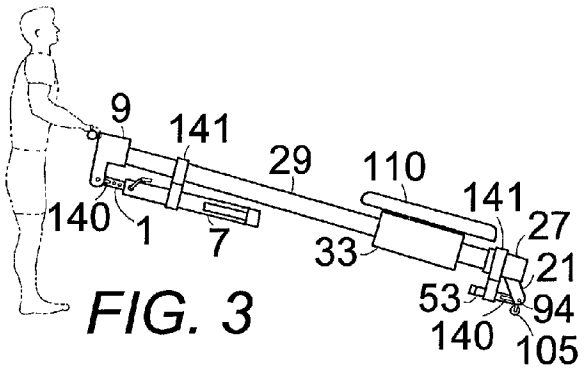
FIG. 3 is a side elevational view of the preferred embodiment of the invention of FIG. 1 reduced in size and complexity and with the front and rear stanchions pivoted into alignment with the monorail and secured thereto with a wheel exposed for moving the invention by rolling on the wheel.
Figure 2:
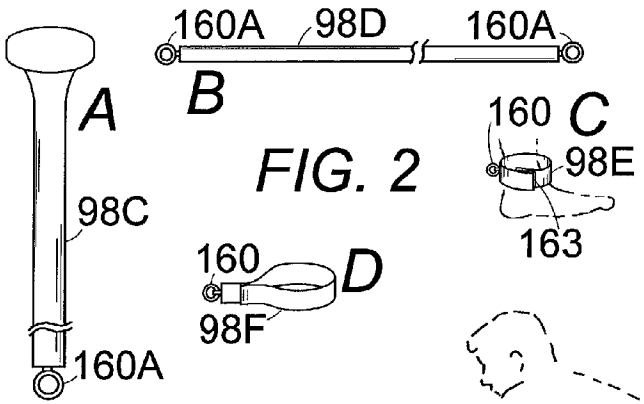
FIGS. 2A, 2B, 2C, and 2D show alternate embodiments of the handle device including a simulated canoe paddle, a simulated kayak paddle, an ankle strap, and a webbing hand loop respectively.

In FIG. 3, a pivotable means comprises a sliding bar 53 fitting slidably into a rear post 21 extending downwardly from the rear monorail support 27 in the rear support structure and the telescoping bar 1 fitting slidably into a front post 7 extending downwardly from the front monorail support 9. The sliding bar 53 and the telescoping barn each have a slot 140 through which a pin 94 passes to enable the sliding bar and telescoping bar to be pulled downwardly to the top of each slot 140 and pivoted into parallel alignment with the monorail 29 and secured thereto by a strap 141 so that the apparatus folds up into a flat configuration for ease of transporting and storing. A rotatable wheel 105 protrudes downwardly from the rear support with the rear support pivoted into parallel alignment with the monorail so that the apparatus may easily be rolled to move it as shown in FIG. 3.

Figure 5:
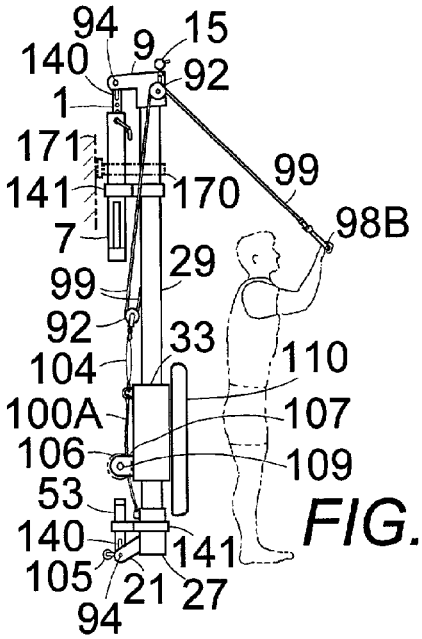
FIG. 5 is a side elevational view of the preferred embodiment of the invention of FIG. 1 shown reduced in size and complexity with the stanchions folded into alignment with the monorail and secured thereto and the invention positioned vertically and secured to a wall by a wall bracket for using the pulley system of the invention while standing adjacent to the invention.

In FIG. 5, a wall-mountable bracket 170, secured to a wall 171, is capable of receiving and supporting the invention mounted vertically on a wall. The supports of the apparatus are folded into the flat position with the front and rear supports pivoted into alignment with the monorail 29 and secured thereto by straps 141 so that the pulley cable 99 system may be used to raise the roller carriage 33. A weight bracket 107 and weight bar 109 and a changeable weight 106 are attached to the roller carriage 33 for variable resistance, thereby creating a vertical pulley exercise device.

Figure 7:
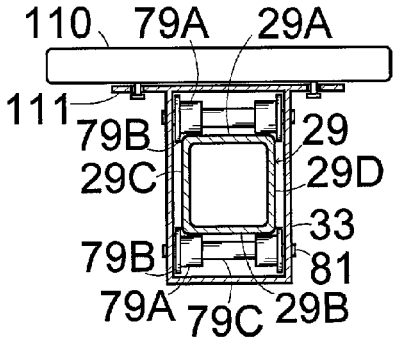
FIG. 7 is a cross-sectional view taken through the roller carriage 33 and monorail 29 of the preferred embodiment of the invention of FIG. 1.
Figure 8:
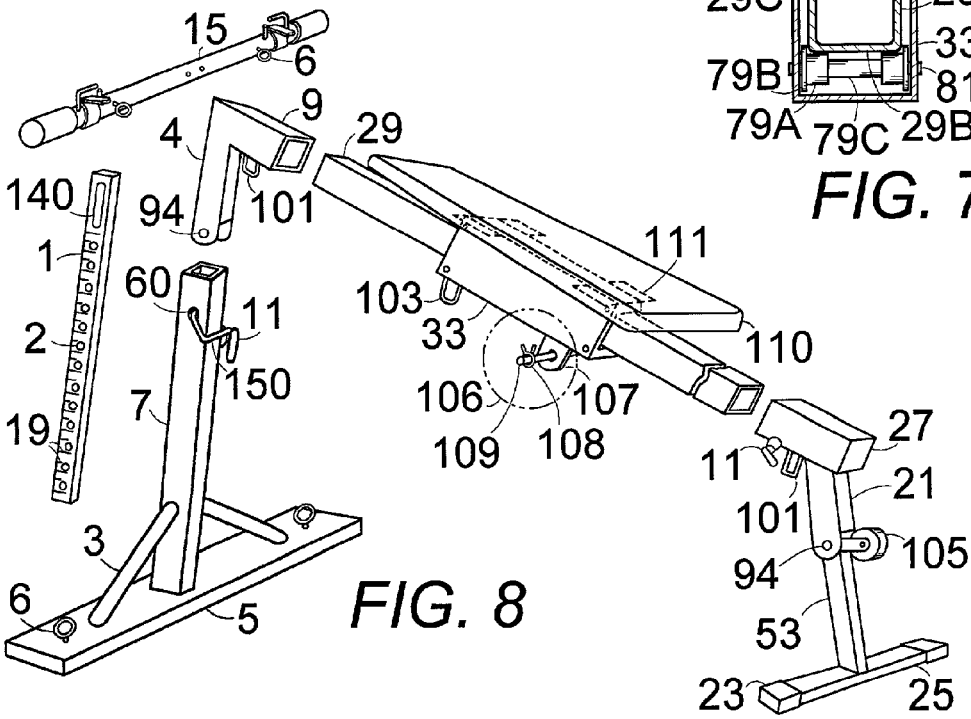
FIG. 8 is an exploded perspective view of a portion of the preferred embodiment of the invention of FIG. 1.

In FIGS. 7 and 10 rollers 79 are mounted on axles 81 of roller carriage 33. Carriage 33 is free to translate along monorail 29 as rollers 79 roll along the upper and lower surfaces of the monorail. In FIG. 7, flanges 111 extending laterally from the top side edges of the roller carriage are used to attach the preferred embodiment of the padded bench 110 by means of bolts or other standard fasteners (not shown) secured through the flanges 111, as indicated in FIGS. 1 and 8.

Alternately in FIGS. 11 and 12 the padded bench 110 is provided with tube brackets 85 which enable the padded bench to be mounted interchangeably with a bicycle-type seat 45 by means of an interchange tube 43 inserted through the tube brackets 85 and releasably attached to carriage 33 by interchange tube brackets 41. Brackets 41 are fixedly attached to the roller carriage 33. In FIGS. 4 and 9, the bicycle-type seat bracket 42 and thigh pad support bracket 44 are mounted along tube 43. The bicycle-type seat 45 is attached to bracket 42, and thigh support assembly 46 is attached to bracket 44. The alternate embodiment of the body support means comprising a seat carriage having a seat 45, a front thigh pad 46, and foot stirrup 37 may be used for simulated skiing movements.

Stirrup sleeves 35 attached to the roller carriage 33 are dimensioned to receive two telescoping stirrup tubes 39. Horizontal stirrup 37 is fixedly attached to the lower ends of the stirrup tubes 39. The user (shown dashed in FIG. 4) may assume a standing posture as he (or she) rests on the bicycle-type seat 45, rests his (or her) feet on the stirrup 37, and braces his (or her) thighs against the thigh supports of assembly 46. The user may then grip strap 31 with one hand and strap 32 with the other hand. As the user pulls on both straps simultaneously, the user's thighs will cause the roller carriage 33 to roll forward and upward along the inclined monorail 29 as indicated by the forward dashed image. Upon reaching the high forward position, the user will cease to pull on straps 31 and 32 so that the roller carriage 33 will freely roll back toward the rear sleeve 27. In this way, the user (in a standing position) may repeatedly execute a skiing motion using handles 98B (simulating simultaneous manipulation of two ski poles), to develop endurance and upper body strength.

In FIGS. 7 and 10, the details of the roller carriage assembly are clearly shown. Axles 81 are mounted within carriage 33, and a spool-shaped roller 79 is mounted on each axle 81. Each roller 79 has a small diameter central portion, two intermediate diameter outer portions 79*a*, and two large diameter end portions 79*b*. Outer portions 79*a* are dimensioned to engage with either the upper surface 29*a* or the lower surface 29*b* of the monorail 29, and end portions 79*b* are dimensioned to engage with either the vertical left surface 29*c* or the vertical right surface 29*d* of monorail 29. Thus, two of rollers 79 (one positioned at the forward end of carriage 33; the other positioned at the rear end of carriage 33) will roll along the upper surface 29*a* of monorail 29 (with end portions 79*b* guided by left and right surface 29*c* and 29*d*) and the other two of rollers 79 (one positioned at the forward end of carriage 33; the other positioned at the rear end of carriage 33) will roll along the lower surface 29*b* of monorail 29 (with end portions 79*b* guided by left and right surfaces 29*c* and 29*d*), allowing carriage 33 to translate along monorail 29 with excellent stability.

Stirrup tubes 39 are perforated in the same manner as the front support telescoping tube 1 is perforated, so that tubes 39 may be attached to stirrup sleeves 35 by pins 59 in any of a number of different positions.

Carriage interchange tube 43 may be positioned through tube brackets 41, and locked in place by quick release assemblies 11. To convert the inventive apparatus to a ski simulation device, after tube 43 is pushed through one of brackets 41, tube 43 is also pushed through seat bracket 42 (of the bicycle seat assembly including bicycle-type seat 45 and bracket 42) and through thigh pad bracket 44 (of the thigh pad assembly including thigh pads 46 and bracket 44). Tube 43 is then pushed through the other one of brackets 41, and all brackets are locked with tube 43 by tightening quick release assemblies 11.

In FIG. 9, an optional weight bracket 73 (of the weight assembly comprising bracket 73 and weight bar 75) may be positioned around tube 43 and locked in place by tightening the quick release assembly 11 attached to bracket 73. Weights 77 may be positioned along weight bar 75. The weight assembly may be attached around tube 43 whether or not the bicycle seat assembly and the thigh pad assembly are attached around tube 43.

FIG. 11 shows a swim bench assembly, including swim bench 83 and two bench brackets 85. The FIG. 11 swim bench assembly may be substituted for the bicycle seat assembly and thigh pad assembly shown in FIG. 9, by passing tube 43 through brackets 85 and tightening quick release assemblies to lock brackets 85 to tube 43.

FIG. 12 shows a variation of the FIG. 4 embodiment in which the swim bench assembly of FIG. 11 is substituted for the bicycle seat assembly and thigh pad assembly shown in FIG. 4 (and in FIG. 9). The bench 83 is padded, so that a user (shown dashed) may comfortably lie on it while pulling on paddles 98A to translate carriage 33 along monorail 29. In this manner, the FIG. 12 apparatus allows the user to perform a simulated swimming exercise.

To readily convert the FIG. 12 apparatus back to its FIG. 4/FIG. 9 configuration, brackets 41 and 85 are released from tube 43, paddles 98A are removed from straps 31 and 32, and tube 43 with the bicycle seat assembly and thigh pad assembly mounted thereon is reattached to tube 43 in the manner described with reference to FIG. 9.

In FIG. 5, the user (shown dashed) may stand sit or kneel adjacent to the invention and perform a variety of exercises by grasping any of a variety of handles, such as the bar or handle 98B, attached to the two ends of the cable 99 attached to the roller carriage 33 through the pulleys 92 and move the handle to pull on the cable and pull the roller carriage up the inclined monorail 29. One or more weights 106 added to the roller carriage 33 and a tension strap 100A attached between the roller carriage 33 and the rear support structure may be used to increase the resistance to rolling for developing greater strength.

In FIG. 13 an alternative roller carriage padded bench 110 has downwardly extending sides 190 with inwardly extending alternative larger roller wheels 180 rolling within recessed channels 185 in an alternate embodiment of the monorail 29A of an alternate embodiment of the invention of FIG. 1. A central vertical support 182 has a top and bottom arched plate 183 with the two side channels 185 supported therebetween. The roller motion is smoother and safer with the roller wheels 180 prevented from slipping out of the channels 185.

In FIG. 14 another alternative roller carriage padded bench has a plate 111A with a downwardly extending rectangular beam 233 secured to the underside of the plate and an axle 201 extending through openings 211 in the beam supporting large wheels 200 on each side. The wheels 200 roll within another alternate monorail 229 of an alternate embodiment of the invention of FIG. 1. The monorail is a rigid elongated rectangular element having a hollow interior with a top opening 230 running along its length to permit the roller carriage wheels 200 to roll within the monorail 200 with the rectangular beam 233 of the roller carriage extending out through the top opening 230 and moving therein as the roller carriage moves along the length of the monorail 229.

In FIGS. 15 and 15A, an alternate embodiment the front stanchion has telescoping elements 1A and 7A formed of elongated hollow elliptical or oval steel elements slidably fit together. In FIG. 15, a safety locking pin 150, similar to that of FIG. 6, is formed of rigid metal and has a straight insertion portion 151 insertable through opening 60 in the front stanchion support 7A and through openings 2 in the telescoping tube 1A, and an L-shaped arm 152 which drops down onto the quick release screw mechanism 11 and is secured by the tightening of the quick release mechanism 11. The quick release assembly 11 includes a threaded housing 71A into which the threaded screw 12 of the quick release mechanism is threaded. The housing 71A is fixedly attached to the sleeve of the stanchion 7A around an orifice through sleeve preferably along the narrow edge of the stanchion 7A. To lock members 1A and 7A together, the threaded screw 12 of the quick release mechanism engage with the threads of housing 71A so as to advance the screw 12 inward through the orifice into direct contact with the telescoping tube 1A. The threaded screw 12 may be unscrewed (away from the telescoping tube 1A) to release the telescoping tube 1A from the sleeve of the stanchion 7A. The combination of a safety pin and quick release assembly shown in FIG. 15 may be employed at any of the adjustment points of the inventive system.

In FIGS. 15 and 15A, a straight pin 150A is inserted through the openings 60 in the stanchion 7A and the openings 2 in the tube 1A and the quick release screw mechanism 11 works the same way as in FIG. 15 except that it does not engage the pin. The combination of a safety pin and quick release assembly shown in FIGS. 15 and 15A may be employed at any of the adjustment points of the inventive system.

A structural object of the present invention is to provide all of the components of the apparatus with a rust-proof exterior surface to allow the apparatus to be placed in a high moisture or corrosive environment, especially important if the machine is used in a damp environment, such as adjacent to a pool or near ocean air. It is preferred to fabricate the frame parts of stainless steel or regular steel that is coated in powder coat epoxy or aluminum or plastic (molded or extruded) and a monorail that is made from either stainless steel, aluminum or chrome plated steel depending on the model for durability and greater resistance to corrosion.

The foregoing is merely illustrative and explanatory of the inventive apparatus. Various changes in the component materials, sizes and shapes, and other details of the embodiments described herein may be within the scope of the appended claims.

What is claimed is:

1. An exercise apparatus which enables simulating a variety of sports activities for the purpose of training, the apparatus comprising:

a front rigid support structure;

a rear rigid support structure lower than the front support structure;

a monorail having a first end attached to the front support structure and a second end attached to the rear support structure so that the monorail is supported at an inclined angle to the horizontal;

a roller carriage mounted on the monorail so that the roller carriage is adapted for rolling along the monorail between the rigid support structures;

a body support means removably attached to the roller carriage and adapted for receiving a body of a user mounted thereon;

a flexible pull means attached to the front support structure, so that a user mounted on the body support means is adapted for using the pull means to simulate sports movements and move the roller carriage from the rear support structure up the inclined monorail toward the front support structure;

an elongated rigid bar mounted on the front support structure, the bar having a guide means on each side of the front support structure for maintaining the pull means in a fixed position wrapped around the bar;

a tension means removably attachable between the roller carriage and one of the support structures for altering the ability to move the roller carriage along the inclined monorail;

wherein the body support means comprises an elongated padded bench contoured to cradle the body of the user lying on the bench and sufficiently wide to accommodate a wide range of body sizes while tapering in the front to provide greater freedom of movement of the arms and maximum stability for use in simulated swimming movements;

a pulley means attachable to the bar on each side of the front support structure and a cable means inserted through both of the pulley means and through a third pulley attached to the roller carriage, the cable means having a first end a second end free to grasp by a user, the ends each having a means to receive at least one gripping means attached thereto, the cable means adapted for being used while the user is mounted on the roller carriage or with the user positioned adjacent to the apparatus for various types of exercises.

2. The apparatus of claim 1 wherein the rear support structure is of a minimum height required to maintain a user mounted on the body support means in a reclined position so that the user's feet do not touch a horizontal surface supporting the apparatus.

3. The apparatus of claim 2 wherein the rear support structure is 14" high.

4. The apparatus of claim 1 wherein the tension means comprises one of a number of interchangeable rubber stretch cords of different tension strengths to vary the degree of tension by interchanging the cords.

5. The apparatus of claim 1 wherein the tension means is attached between the roller carriage and the rear support structure and the tension means is adapted for resisting the movement of the roller carriage up the inclined monorail.

6. The apparatus of claim 1 wherein the tension means is attached between the roller carriage and the front support structure and the tension means is adapted for assisting the movement of the roller carriage up the inclined monorail.

7. The apparatus of claim 1 further comprising a tension loop means attachable between the third pulley and the roller carriage, the tension means forming a dynamic dampening loop.

8. The apparatus of claim 1 further comprising a wall-mountable bracket means adapted for receiving and supporting the apparatus mounted vertically on a wall so that the pulley cable system may be used to raise the roller carriage and further comprising a weight bracket and weight bar and a changeable weight means attached to the roller carriage, thereby creating a vertical pulley exercise device.

9. The apparatus of claim 1 wherein the front support structure further comprises a base bar extending laterally to each side of the front support structure, the base bar having a pulley attaching means attachable thereto adjacent to each end for each receiving the pulley means attachable thereto so that exercises can be done pulling at a different angle allowing various other kinds of exercises using different muscle groups.

10. The apparatus of claim 1 wherein the bar further comprises a gripping means at each end, each of the gripping means round in cross section for facilitating gripping by a hand of a user to allow the user to perform exercises while gripping the gripping means.

11. The apparatus of claim 1 further comprising an adjustable bar support attachable to the front support structure and a right bar and a left bar adjustably attachable to the adjustable bar support in any of a variety of different settings or angles relative to the monorail, the right and left bars each having the flexible pull means attached thereto to allow the user to vary exercise patterns, simulating different strokes and exercising different muscle groups.

12. The apparatus of claim 1 further comprising a pivotable means in both the front and rear support structures to enable the apparatus to fold up into a flat configuration for ease of transporting and storing.

13. The apparatus of claim 12 further comprising a wheel rotatably attached to one of the support structures, the wheel adapted for contacting the ground with the machine in the flat configuration to allow rolling the machine for ease of movement.

14. The apparatus of claim 1 further comprising a weight bracket and weight bar attach to an underside of the roller carriage, the weight bar adapted for removably receiving a weight means to increase resistance.

15. The apparatus of claim 1 further comprising a front head support and a rear foot support adapted for being removably attached to the padded bench and extending toward the front and rear of the apparatus, respectively, in the plane of the padded bench for performing various types of exercises.

16. The apparatus of claim 1 further comprising a foot platform attachable to the rear support structure and extending upwardly perpendicularly to the monorail, so the user may push off the platform with the feet while the user is mounted on the body support means.

17. The apparatus of claim 1 further comprising a telescoping tube on the front support structure to allow adjustability of the height of the front support structure and therefore adjustability of the angle of the inclined monorail attached between the support structures, the telescoping tube bearing a series of numbers to indicate each height setting for accurate adjustment of the incline.

18. The apparatus of claim 17 further comprising a quick release screw mechanism on the front support structure for engaging the telescoping tube and a safety locking pin formed of rigid metal having a straight insertion portion insertable through an opening in the front support structure and through a mating opening in the telescoping tube, and the safety locking pin having an L-shaped arm extending from the straight insertion portion, which L-shaped arm drops down onto the quick release screw mechanism and is secured by the tightening of the quick release mechanism.

19. The apparatus of claim 1 further comprising a rock climber attachment mountable on the front support structure to serve as a platform that accepts a variety of standard rock climbing wall grips and hand holds to use the apparatus to simulate rock climbing movements.

20. The apparatus of claim 1 wherein the monorail is provided with interior channels to receive rollers from the roller carriage therein so that the roller carriage is adapted for rolling along the length of the monorail with the rollers in the channels.

21. The apparatus of claim 1 wherein all of the components of the apparatus have a rust-proof exterior surface to allow the apparatus to be placed in a high moisture environment.

22. An exercise apparatus which enables simulating a variety of sports activities for the purpose of training, the apparatus comprising:

a front rigid support structure;

a rear rigid support structure lower than the front support structure;

a monorail having a first end attached to the front support structure and a second end attached to the rear support structure so that the monorail is supported at an inclined angle to the horizontal;

a roller carriage mounted on the monorail so that the roller carriage is adapted for rolling along the monorail between the rigid support structures;

a body support means removably attached to the roller carriage and adapted for receiving a body of a user mounted thereon;

a flexible pull means attached to the front support structure, so that a user mounted on the body support means is adapted for using the pull means to simulate sports movements and move the roller carriage from the rear support structure up the inclined monorail toward the front support structure;

a tension means removably attachable between the roller carriage and one of the support structures for altering the ability to move the roller carriage along the inclined monorail;

an elongated rigid bar mounted on the front support structure, the bar having a guide means on each side of the front support structure for maintaining the pull means in a fixed position wrapped around the bar;

a pulley means attachable to the bar on each side of the front support structure and a cable means inserted through both of the pulley means and through a third pulley attached to the roller carriage, the cable means having a first end a second end free to grasp by a user, the ends each having a means to receive at least one gripping means attached thereto, the cable means adapted for being used while the user is mounted on the roller carriage or with the user positioned adjacent to the apparatus for various types of exercises.

23. The apparatus of claim 22 wherein the end of the flexible pull means is adapted for receiving interchangeably a gripping means selected from the group of gripping means consisting of:

an elongated handle round in cross section attached perpendicularly to the cable means;

a hand paddle for receiving a hand of the user flat against the hand paddle;

an ankle strap securable around an ankle of a user;

a webbing loop;

a canoe paddle shaft;

a kayak paddle shaft;

a barbell accessory.

24. The apparatus of claim 22 wherein the body support means comprises a seat carriage having a seat, a front thigh pad, and foot pegs for simulated skiing movements.

25. An exercise apparatus which enables simulating a variety of sports activities for the purpose of training, the apparatus comprising:

a front rigid support structure;

a rear rigid support structure lower than the front support structure;

a monorail having a first end attached to the front support structure and a second end attached to the rear support structure so that the monorail is supported at an inclined angle to the horizontal;

a roller carriage mounted on the monorail so that the roller carriage is adapted for rolling along the monorail between the rigid support structures;

a body support means removably attached to the roller carriage and adapted for receiving a body of a user mounted thereon;

a flexible pull means attached to the front support structure, so that a user mounted on the body support means is adapted for using the pull means to simulate sports movements and move the roller carriage from the rear support structure up the inclined monorail toward the front support structure;

a tension means removably attachable between the roller carriage and one of the support structures for altering the ability to move the roller carriage along the inclined monorail;

an adjustable bar support attachable to the front support structure and a right bar and a left bar adjustably attachable to the adjustable bar support in any of a variety of different settings or angles relative to the monorail, the right and left bars each having the flexible pull means attached thereto to allow the user to vary exercise patterns, simulating different strokes and exercising different muscle groups.

26. The apparatus of claim 25 further comprising an elongated rigid bar mounted on the front support structure, the bar having a guide means on each side of the front support structure for maintaining the pull means in a fixed position wrapped around the bar.

27. The apparatus of claim 26 further comprising a pulley means attachable to the bar on each side of the front support structure and a cable means inserted through both of the pulley means and through a third pulley attached to the roller carriage, the cable means having a first end a second end free to grasp by a user, the ends each having a means to receive at least one gripping means attached thereto, the cable means adapted for being used while the user is mounted on the roller carriage or with the user positioned adjacent to the apparatus for various types of exercises.

28. An exercise apparatus which enables simulating a variety of sports activities for the purpose of training, the apparatus comprising:

a front rigid support structure;

a rear rigid support structure lower than the front support structure;

a monorail having a first end attached to the front support structure and a second end attached to the rear support structure so that the monorail is supported at an inclined angle to the horizontal;

a roller carriage mounted on the monorail so that the roller carriage is adapted for rolling along the monorail between the rigid support structures;

a body support means removably attached to the roller carriage and adapted for receiving a body of a user mounted thereon;

a flexible pull means attached to the front support structure, so that a user mounted on the body support means is adapted for using the pull means to simulate sports movements and move the roller carriage from the rear support structure up the inclined monorail toward the front support structure;

a tension means removably attachable between the roller carriage and one of the support structures for altering the ability to move the roller carriage along the inclined monorail;

a rock climber attachment mountable on the front support structure to serve as a platform that accepts a variety of standard rock climbing wall grips and hand holds to use the apparatus to simulate rock climbing movements.

* * * * *